US005382191A

United States Patent [19]

Rasmussen

[11] Patent Number: 5,382,191

[45] Date of Patent: Jan. 17, 1995

[54] COIN QUEUING DEVICE AND POWER RAIL SORTER

[75] Inventor: James M. Rasmussen, Chicago, Ill.

[73] Assignee: Cummins-Allison Corp., Mt. Prospect, Ill.

[21] Appl. No.: 37,269

[22] Filed: Mar. 26, 1993

[51] Int. Cl.[6] ..... G07D 3/12

[52] U.S. Cl. ..... 453/11; 453/56; 453/57

[58] Field of Search ..... 453/6, 7, 10, 11, 12, 453/32, 56, 57

[56] References Cited

U.S. PATENT DOCUMENTS

| | | | |
|---|---|---|---|
| 574,528 | 1/1897 | Elder . | |
| 1,390,583 | 9/1921 | Paul . | |
| 1,793,886 | 2/1931 | Weber . | |
| 3,016,191 | 1/1962 | Buchholz . | |
| 3,026,982 | 3/1962 | Buchholz . | |
| 3,771,538 | 11/1973 | Reis | 453/12 |
| 3,837,139 | 9/1974 | Roseberg . | |
| 3,991,778 | 11/1976 | Ushio et al. . | |
| 3,998,237 | 12/1976 | Kressin et al. . | |
| 4,059,122 | 11/1977 | Kinoshita . | |
| 4,506,685 | 3/1985 | Childers et al. . | |
| 4,607,649 | 8/1986 | Taipale et al. | 453/6 |
| 4,731,043 | 3/1988 | Ristvedt et al. | 453/6 |
| 4,881,918 | 11/1989 | Goh et al. | 453/56 X |
| 4,988,860 | 1/1991 | Wollet et al. . | |
| 5,026,320 | 6/1991 | Rasmussen . | |

FOREIGN PATENT DOCUMENTS

| | | | |
|---|---|---|---|
| 2515837 | 10/1975 | Germany . | |
| 2614560 | 10/1977 | Germany . | |
| 1288674 | 9/1972 | United Kingdom . | |
| 91/18371 | 11/1991 | WIPO | 453/10 |

*Primary Examiner*—F. J. Bartuska
*Attorney, Agent, or Firm*—Arnold, White & Durkee

[57] ABSTRACT

A coin queuing device for receiving coins of the same or mixed denominations and delivering the coins to a fixed feed station in single file, in a single layer, and with one edge of each coin positioned at a common reference location. The device comprises a rotatable disc with a resilient upper surface, a drive means for rotating the rotatable disc, coin feed means for feeding coins to the resilient upper surface of the rotatable disc, a coin containment wall extending around the outer periphery of the disc to prevent coins from flying off the disc when the disc is rotated, and a stationary head positioned over a portion of the rotatable disc for engaging the upper surfaces of coins carried beneath the stationary head by the rotatable disc. The stationary head includes a channel for receiving coins which are carried on the surface of the rotatable disc beneath the stationary head. At least a portion of the radially inner wall of the channel spirals outwardly relative to the center of rotation of the rotatable disc to engage the radially inner edges of all the coins that enter the channel. The inner wall extends to the outer periphery of the rotatable disc for discharging from the disc the coins which are advanced along the inner wall. This coin containment wall is interrupted in the region adjacent the inner wall to permit the discharge of coins from the rotatable disc. The upper surface of at least the exit end of the channel is positioned sufficiently close to the resilient upper surface of the rotatable disc to press coins of all denominations down into the resilient surface as the coins are being discharged from the disc.

17 Claims, 17 Drawing Sheets

COIN QUEUING DEVICE AND POWER RAIL SORTER

FIELD OF THE INVENTION

The present invention relates to coin queuing devices for receiving coins of the same or mixed denominations and delivering those coins to a fixed feed station in single file, in a single layer, and with one edge of all the coins positioned at a common reference location. Coin queuing devices of this type are used for feeding coins to coin sorters, coin wrappers and the like. This invention also relates to power rail sorters, which can be used with the coin queuing device.

SUMMARY OF THE INVENTION

It is a primary object of the present invention to provide an improved coin queuing device for delivering a single file of single-layered coins to a fixed coin feed station with one edge of all the coins aligned with each other.

It is another object of this invention to provide such an improved coin queuing device which delivers the coins with their lower surfaces lying in a common plane, and with the coins moving in a controlled stable manner.

A further object of this invention is to provide such an improved coin queuing device which is capable of delivering coins at a high feed rate.

It is still another object of the invention to provide an improved power rail sorter which is both fast and accurate.

Other objects and advantages of the invention will be apparent from the following detailed description and the accompanying drawings.

DETAILED DESCRIPTION OF THE PREFERRED EMBODIMENTS

Figure 1:
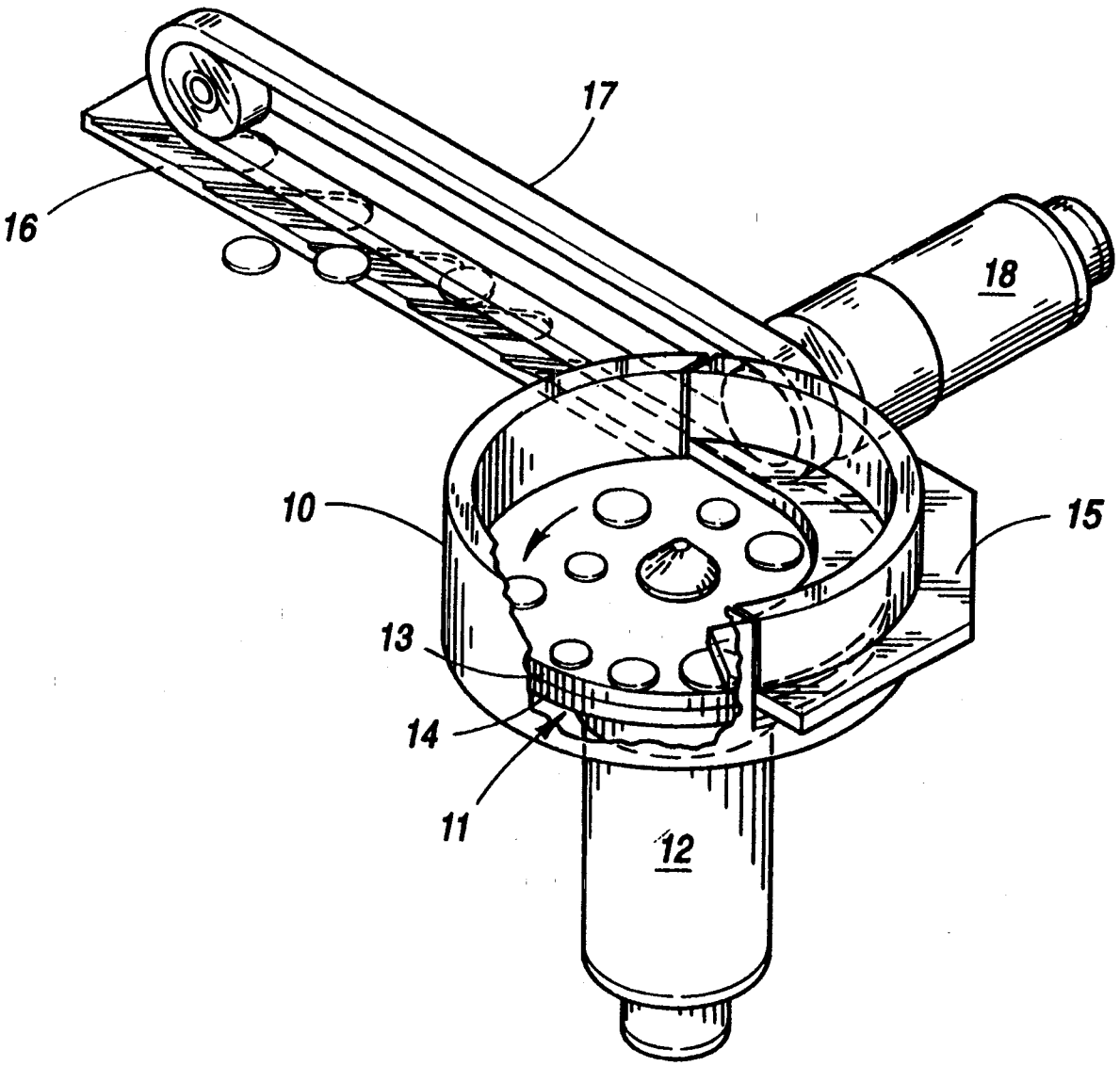
FIG. 1 is perspective view of a coin sorter embodying the present invention, with portions thereof broken away to show the internal structure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

Turning now to the drawings and referring first to FIG. 1, a hollow cylinder 10 receives coins of mixed denominations and feeds them onto the top surface of a rotatable disc 11 mounted for rotation on the output shaft (not shown) of an electric motor 12. The disc 11 comprises a resilient pad 13, preferably made of a resilient rubber or polymeric material, bonded to the top surface of a solid metal plate 14.

As the disc 11 is rotated, the coins deposited on the top surface thereof tend to slide outwardly over the surface of the pad 13 due to centrifugal force. As the coins move outwardly, they engage either the inside wall of the cylinder 10 or a queuing head 15 mounted over a peripheral portion of the disc 11 from about the 8 o'clock position to about the 1 o'clock position (see FIG. 2).

The queuing head 15 delivers a single layer of coins in a single file to a sorting rail 16 which sorts the coins by size. A drive belt 17, driven by an electric motor 18, drives the coins along the sorting rail 16.

As the disc 11 is rotated (in the clockwise direction as viewed in FIG. 2), coins adjacent the cylinder 10 are carried into engagement with the entry end 20 of the queuing head 15. Coins can be rotated beneath the queuing head by entering a channel 21 having converging inner and outer walls 22 and 23. The inner wall 22 spirals outwardly (relative to the center of the disc 13) to about the 12 o'clock position, and then continues along a straight tangential line which crosses the periphery of the disc 11 at about the 11 o'clock position. The outer wall 23 has a constant radius from about 8 o'clock to about 9 o'clock, then spirals inwardly from 9 o'clock to about 11 o'clock to form a channel with converging walls in that region of the queuing head. Beyond the 11 o'clock position, the outer wall 23 parallels the inner wall 22, thereby forming a channel of constant width.

The lowermost surface 24 of the queuing head 15 is preferably spaced from the top surface of the pad 13 by only a few thousandths of an inch, so that coins cannot escape from the channel 21 by passing beneath the outer wall 22, and so that coins cannot enter the channel 21 from the inner periphery 25 of the head 15.

Figure 2:
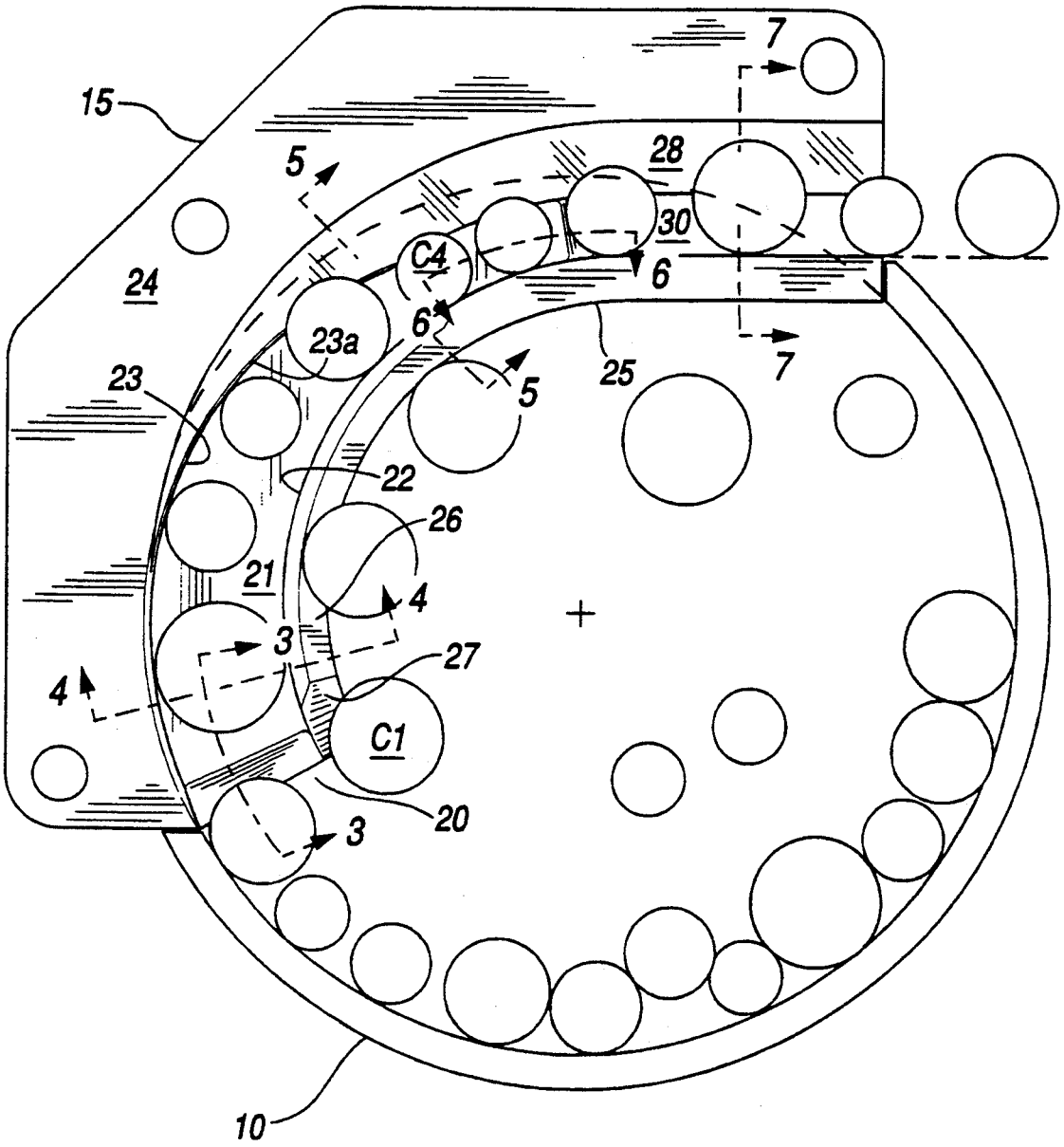
FIG. 2 is an enlarged plan view of the coin-queuing portion of the coin sorter of FIG. 1, taken from the top surface of the rotating pad looking upwardly, with various coins superimposed thereon.
Figure 3:
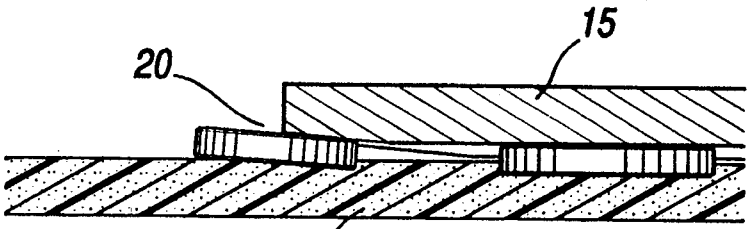
FIG. 3 is an enlarged section taken generally along the line 3—3 in FIG. 2, showing the coins in full elevation.
Figure 5:
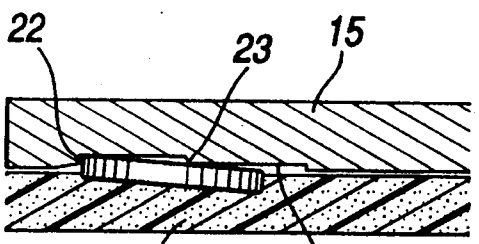
FIG. 5 is an enlarged section taken generally along line 5—5 in FIG. 2, showing the coins in full elevation.
Figure 4:
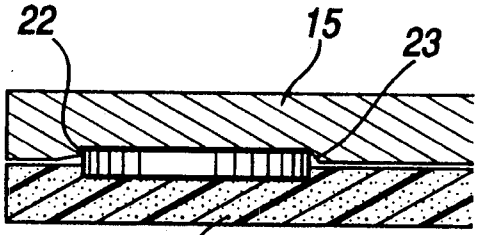
FIG. 4 is an enlarged section taken generally along line 4—4 in FIG. 2, showing the coins in full elevation.
Figure 7:
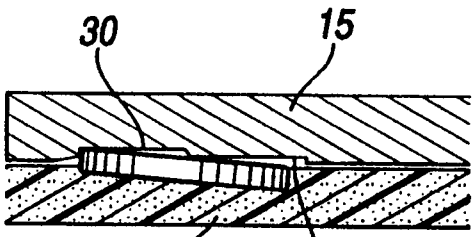
FIG. 7 is an enlarged section taken generally along line 7—7 in FIG. 2, showing the coins in full elevation.
Figure 6:
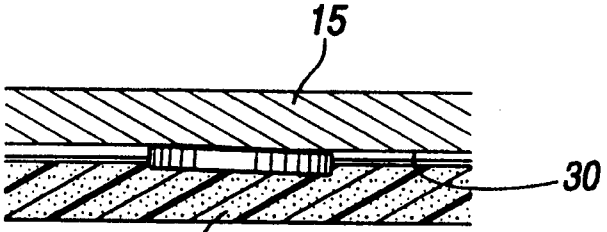
FIG. 6 is an enlarged section taken generally along line 6—6 in FIG. 2, showing the coins in full elevation.

The lowermost surface 24 of the queuing head 15 forms a land 26 along the entire inner edge of the head. The upstream end of the land 26 forms a ramp 27 which presses any coin brought into engagement therewith downwardly into the resilient pad 13, which causes the engaged coin to be recirculated. More specifically, coins which are pressed down into the pad 13 by the ramp 27, such as the coin C1 in FIG. 2, are carried along a path of constant radius beneath the land 26, while the inner edge of the head 15 spirals outwardly from the center of the disc 11. Eventually, therefore, the coin is rotated clear of the inner edge of the head 15 and is then free to move outwardly against the cylinder 11 and to be recirculated to the entry end 20 of the head 15.

The channel 21 causes all coins which enter the channel, regardless of different thicknesses and/or diameters, to exit the channel with a common edge (the inner edges of all coins in FIGS. 1-26) aligned at the same position so that the opposite (outer) edges of the coins can be used for sorting. As can be seen in FIG. 2, the tangential portion of the inner wall 22 at the exit end of the queuing head 15 forms the final gaging wall for the inner edges of the coins as the coins exit the queuing head.

A major portion of the inwardly spiraling portion of the wall 23 is tapered, as at 23*a*, to enable the outer portions of the coins to pass under that wall as the channel 21 converges to a width that is smaller than the diameters of the respective coins. The region 28 immediately outboard of the wall 23 presses the portions of all coins extending outwardly beyond the wall 23 down into the resilient pad 13, thereby tilting the inner edges of the coins upwardly into firm engagement with the gaging wall 22.

Figure 8:
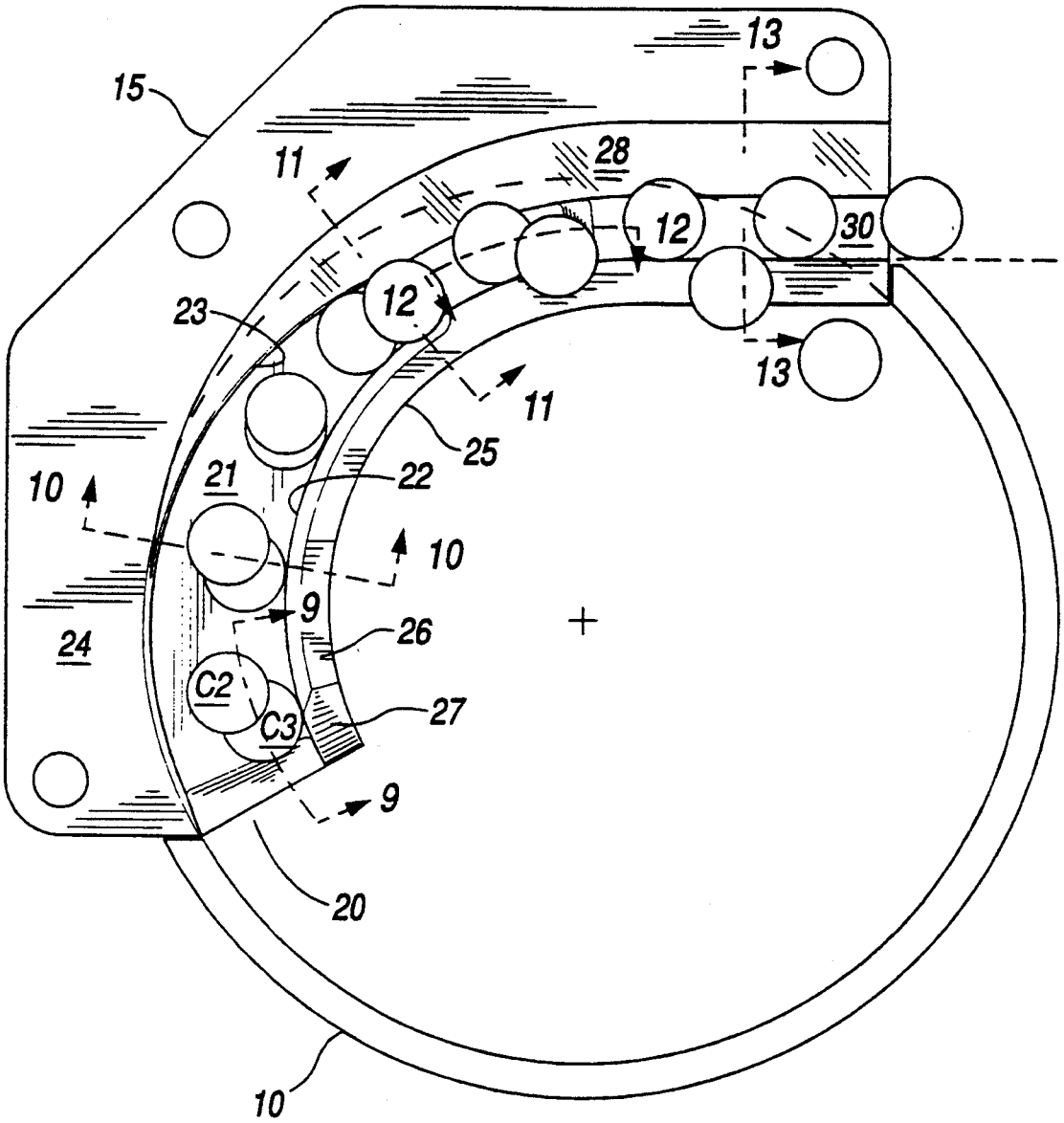
FIG. 8 is the same plan view shown in FIG. 2, with a different arrangement of coins superimposed thereon.
Figure 9:
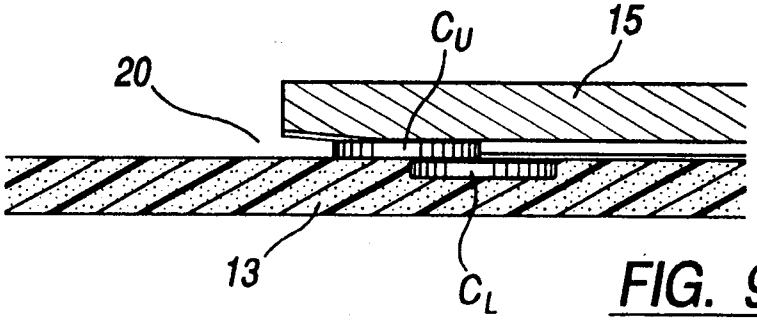
FIG. 9 is an enlarged section taken generally along line 9—9 in FIG. 8 in showing the coins in full elevation.
Figure 11:
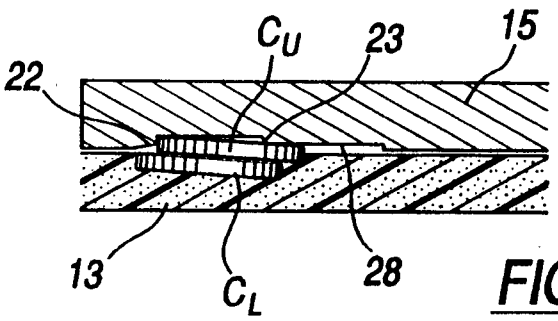
FIG. 11 is an enlarged section taken generally along line 11—11 in FIG. 8, showing the coins in full elevation.
Figure 13:
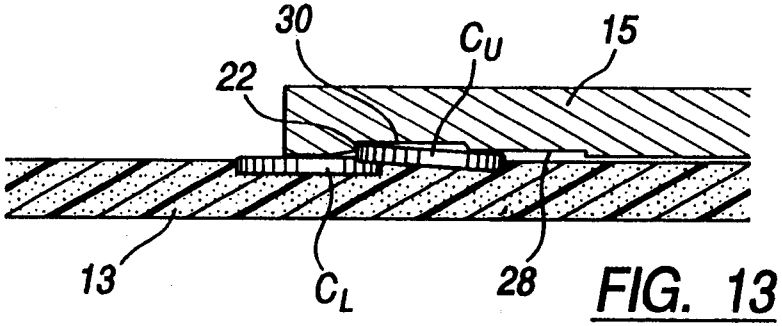
FIG. 13 is an enlarged section taken generally along line 13—13 in FIG. 8, showing the coins in full elevation.
Figure 10:
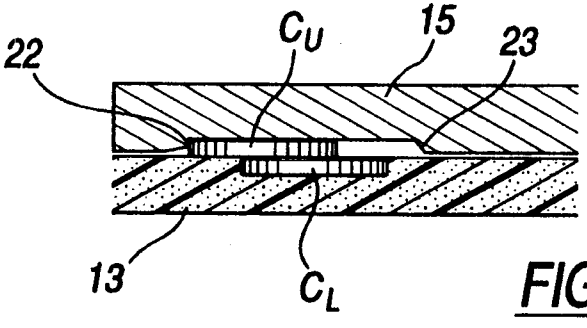
FIG. 10 is an enlarged section taken generally along line 10—10 in FIG. 8, showing the coins in full elevation.
Figure 12:
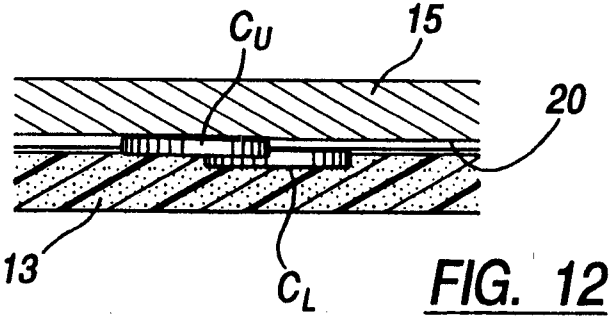
FIG. 12 is an enlarged section taken generally along line 12—12 in FIG. 8, showing the coins in full elevation.
Figure 14:
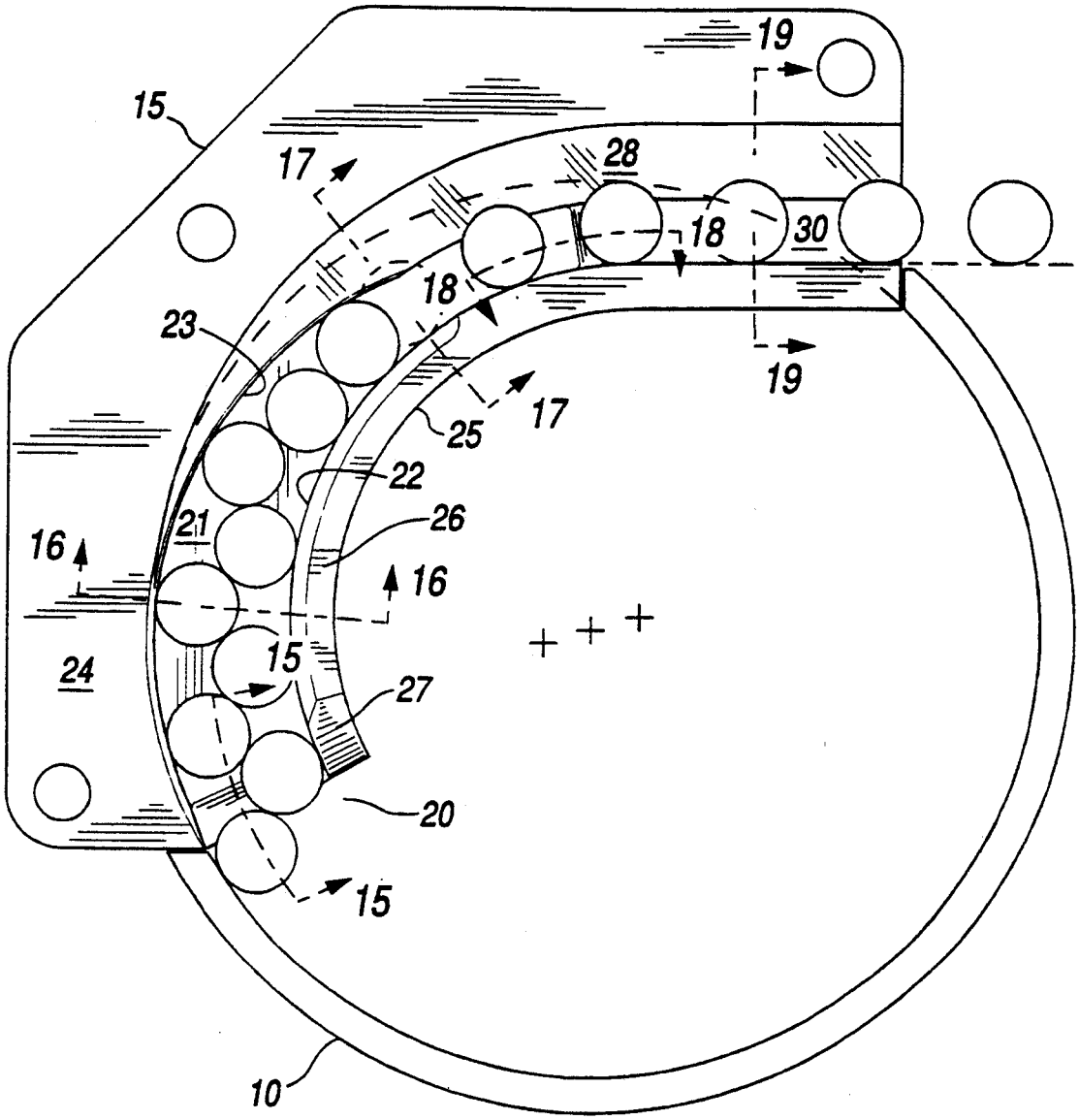
FIG. 14 is the same plan view shown in FIG. 2, with a different arrangement of coins superimposed thereon.
Figure 15:
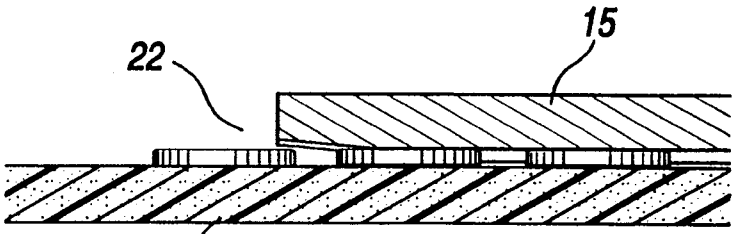
FIG. 15 is an enlarged section taken generally along line 15—15 in FIG. 14, showing the coins in full elevation.
Figure 17:
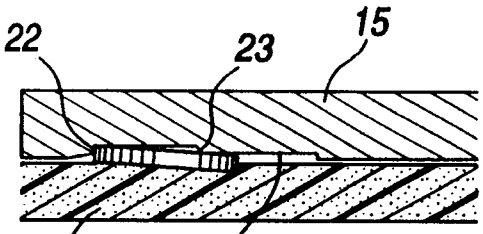
FIG. 17 is an enlarged section taken generally along line 17—17 in FIG. 14, showing the coins in full elevation.
Figure 16:
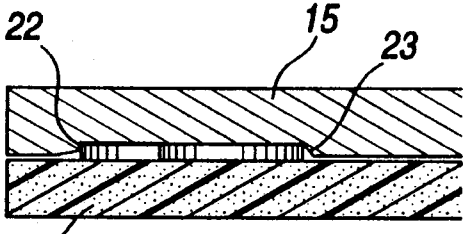
FIG. 16 is an enlarged section taken generally along line 16—16 in FIG. 14, showing the coins in full elevation.
Figure 19:
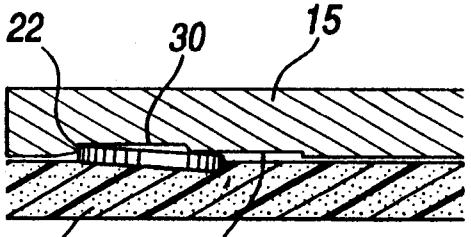
FIG. 19 is an enlarged section taken generally along line 19—19 in FIG. 14, showing the coins in full elevation.
Figure 18:
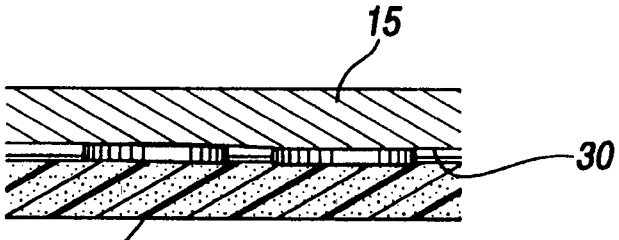
FIG. 18 is an enlarged section taken generally along line 18—18 in FIG. 14, showing the coins in full elevation.

The channel 21 strips apart stacked or shingled coins, as illustrated in FIGS. 8-13. The combined thickness of a pair of stacked or shingled coins of any denomination is great enough to cause the lower coin in that pair to be pressed into the resilient pad 13 (see FIG. 9). Consequently, that pair of coins will be rotated concentrically with the disc, as illustrated by the coin pairs C2 and C3 in FIG. 8. Because the inner wall 22 spirals outwardly, the upper coin $C_u$ will eventually engage the upper vertical portion of the inner wall 22, as illustrated in FIGS. 10 and 11, and the lower coin $C_l$ will pass beneath the wall 22, as illustrated in FIGS. 10-13. As shown in FIG. 8, the latter coin $C_l$ will be recirculated back to the entry region of the sorting head and will later re-enter the channel 21.

When coins enter the channel 21 in staggered relationship, as illustrated in FIGS. 14-19, the spacing between any pair of successive coins gradually decreases due to the decreasing width of the channel as such coins are advanced along the channel by the rotating disc. Consequently, coins which are staggered at the inlet end of the channel 21 are gradually brought into single file by the time they reach the point where the distance between the walls 22 and 23 is reduced to the diameter of the smallest coin. This alignment of the coins into a single file is achieved progressively along the length of the channel, so that the coins move smoothly and continuously through the channel at high throughput rates.

Figure 20:
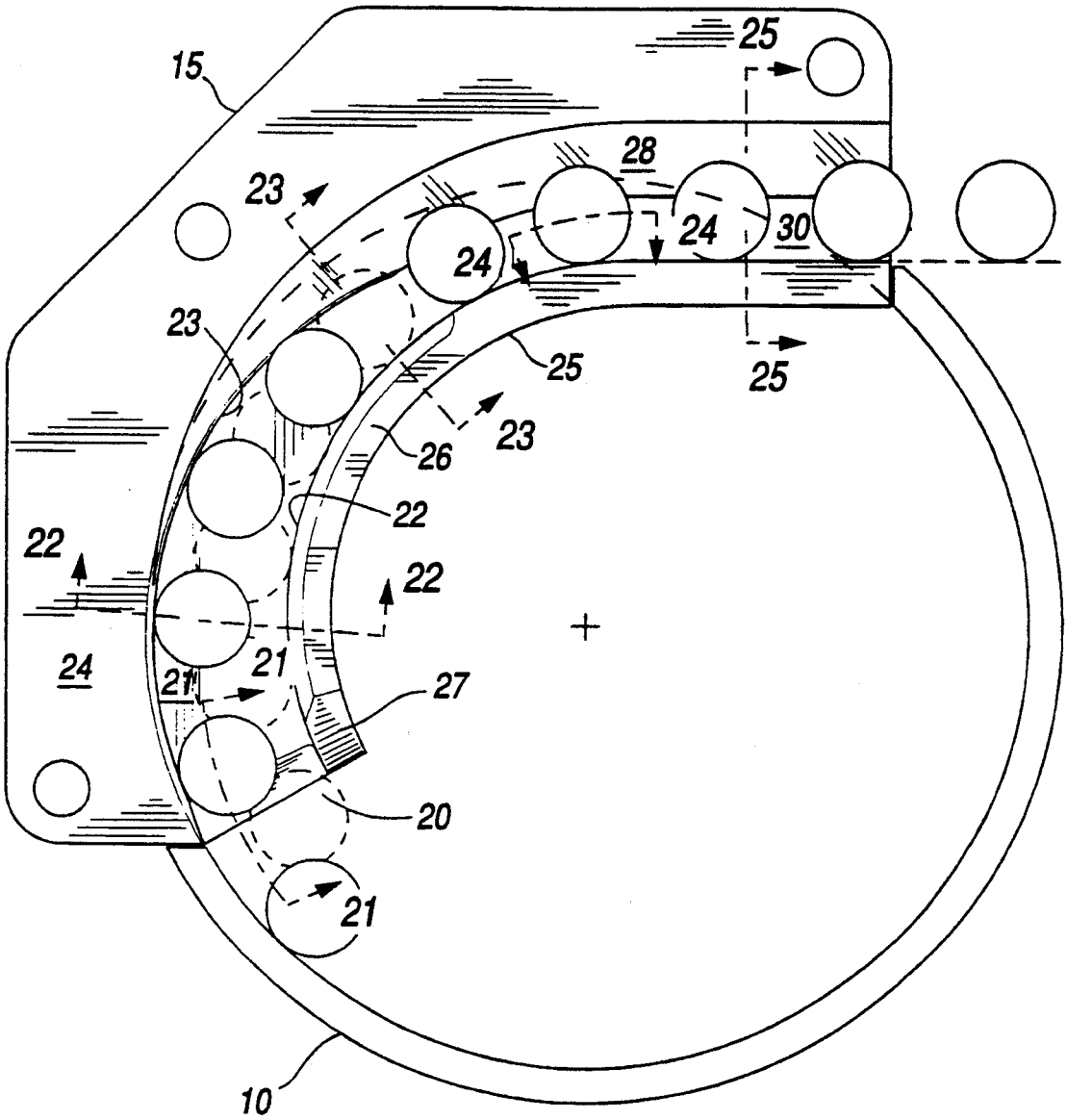
FIG. 20 is the same plan view shown in FIG. 2, with a different arrangement of coins superimposed thereon.
Figure 21:
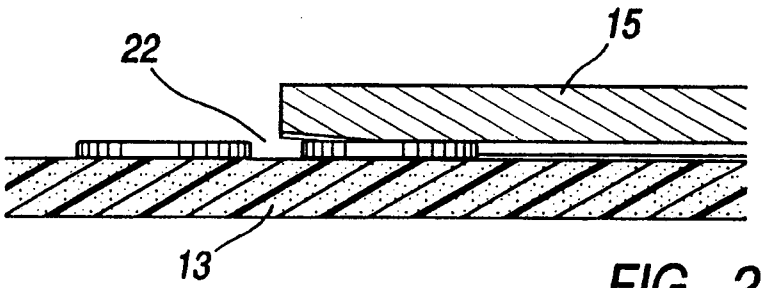
FIG. 21 is an enlarged section taken generally along line 21—22 in FIG. 20, showing the coins in full elevation.
Figure 23:
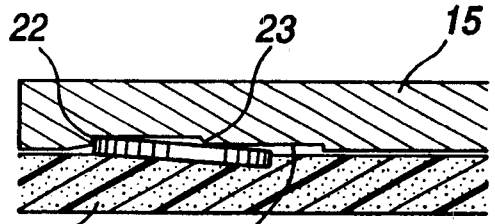
FIG. 23 is an enlarged section taken generally along line 23—23 in FIG. 20, showing the coins in full elevation.
Figure 22:
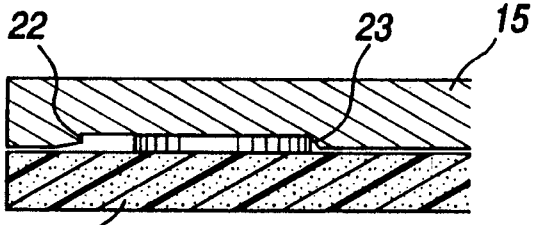
FIG. 22 is an enlarged section taken generally along line 22—22 in FIG. 20, showing the coins in full elevation.
Figure 25:
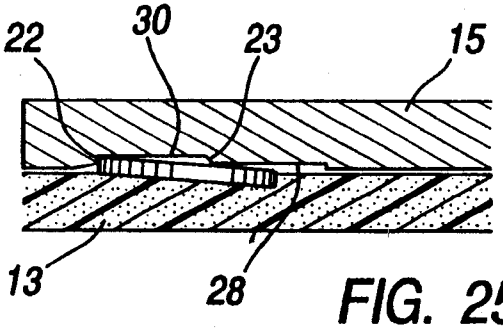
FIG. 25 is an enlarged section taken generally along line 25—25 in FIG. 20, showing the coins in full elevation.
Figure 24:
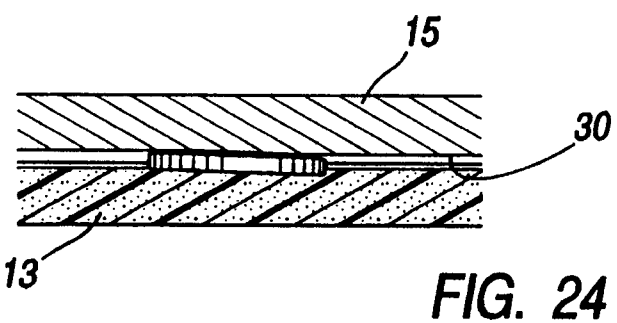
FIG. 24 is an enlarged section taken generally along line 24—24 in FIG. 20, showing the coins in full elevation.

Small, thick coins which have not moved out against the cylinder 11 may still enter the channel 21, as illustrated by the coins shown in broken lines in FIG. 20, and follow the path illustrated in FIGS. 21-25. These coins have a diameter small enough to enable them to enter the channel 21, even though their outer edges are spaced inwardly from the cylinder 11. The thickness of these coins is greater than the distance between the channel ceiling and the resilient pad, as a result of which the coins are pressed into the resilient pad (see FIG. 22). Consequently, these coins move concentrically with the disc until they engage one of the walls 22 or 23 (see FIGS. 22 and 23). If the engaged wall is the outer wall 23, the coins are guided by that wall until they engage the inner wall 22. Thus the small, thick coins always exit the channel 21 with the inner edges of the coins on the gaging wall 22, regardless of where those coins initially enter the channel.

Thin coins are not pressed into the resilient pad in the converging portion of the channel region between the inner and middle walls 22 and 23, and thus such coins move outwardly until they engage the wall 23. The coins follow that wall until the inner edges of the coins come into engagement with the inner wall 22, which gradually forces the outer portions of the coins under the tapered wall 23, as illustrated by coin C4 (FIG. 2). It can be seen that the effect will be the same for a thin coin of any diameter.

At about the 12 o'clock position, as viewed in FIG. 2, the walls 22 and 23 both extend along lines which are tangents to the arcs defining the respective walls just before the 12 o'clock position. These tangential walls guide the coins off the disc 11 to the desired coin-receiving device such as a coin-sorting or coin-wrapping mechanism. To ensure stability of the coins as they leave the rotating disc 11, the depth of the channel between the walls 22 and 23 is reduced at 30 so that the tangential portion of that channel (beyond the 12 o'clock position) is shallower than the thickness of the thinnest coin. Consequently, the coins of all denominations are pressed firmly into the resilient pad 13 as the coins leave the disc.

The sorting rail 16 and the drive belt 17 are shown in more detail in FIGS. 26–30. The sorting rail 16 comprises an elongated plate 50 which forms a series of coin exit channels 51, 52, 53, 54, 55 and 56 which function to discharge coins of different denominations at different locations along the length of the plate 50. The top surface of the plate 50 receives and supports the coins as they are discharged from the disc 11. Because the coins are pressed into the resilient surface of the disc 11, the top surface of the plate 50 is positioned below the lowest coin-engaging surface of the head 15, at the exit end thereof, by about the thickness of the thickest coin. If desired, the entry end of the plate 50 may be tapered slightly to facilitate the transfer of coins from the disc 11 to the sorting rail 16.

Figure 26:
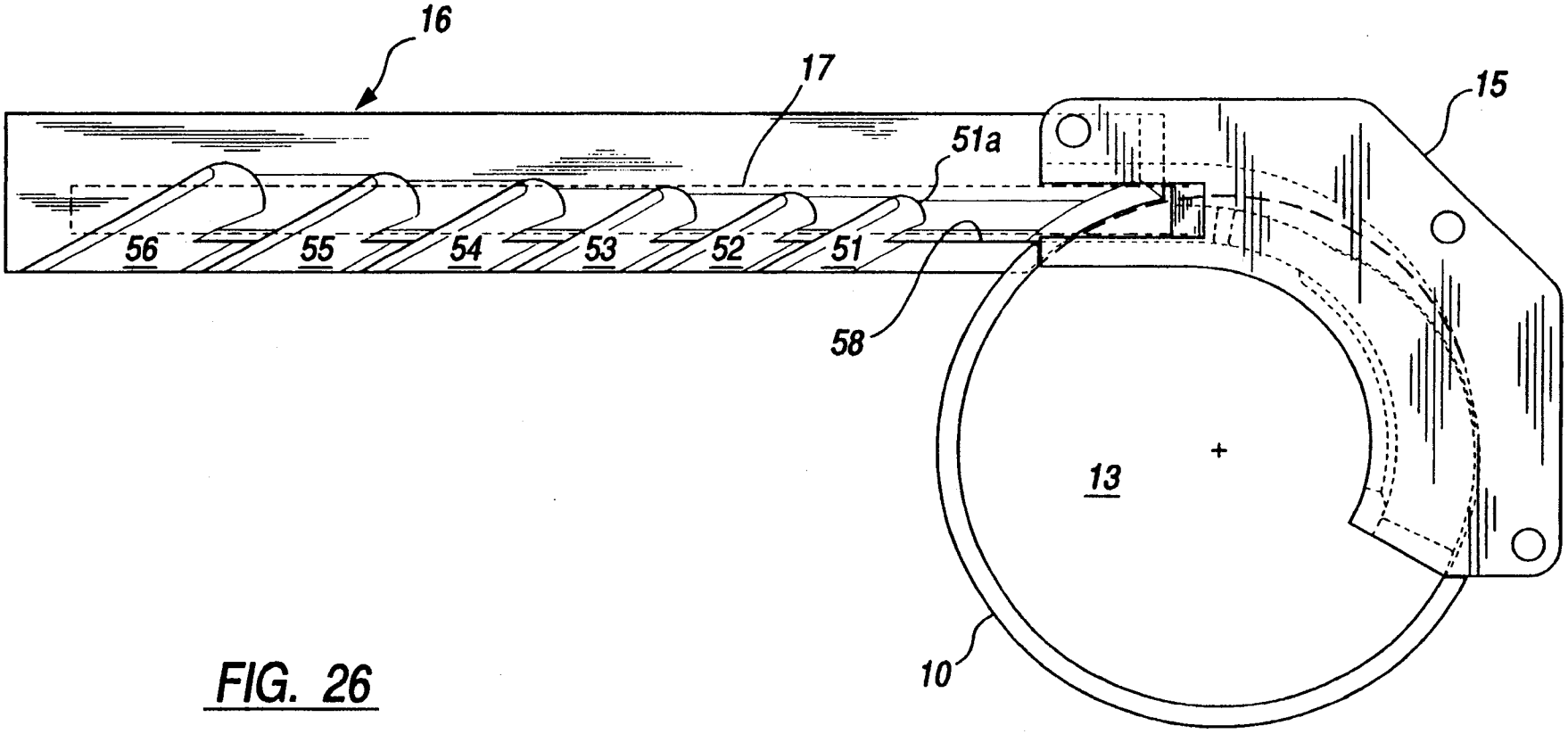
FIG. 26 is a top plan view of the coin sorter of FIG. 1.
Figure 27:
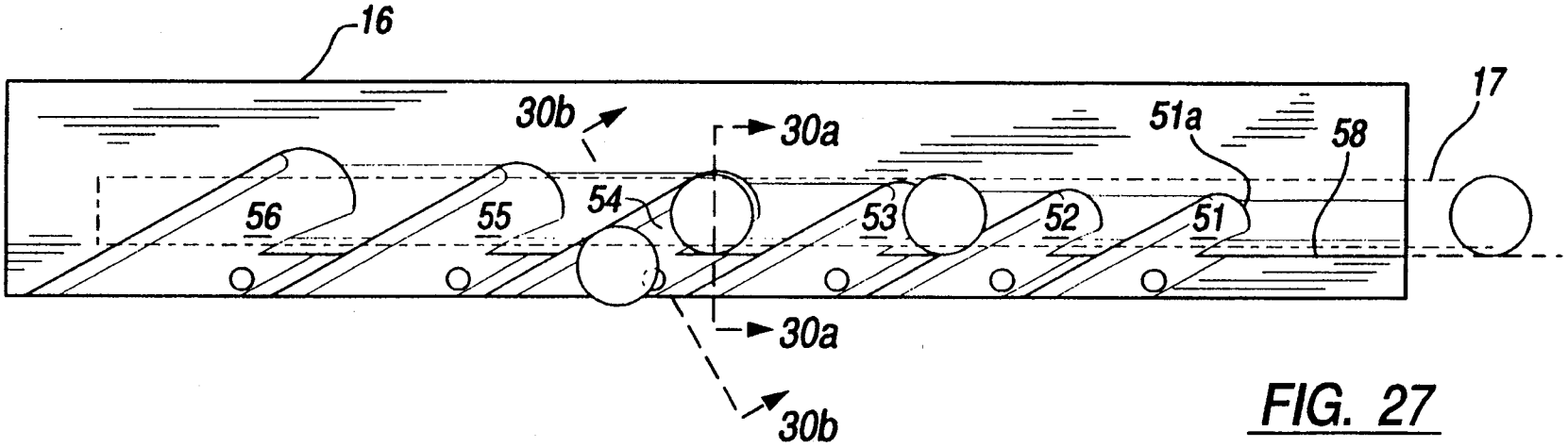
FIG. 27 is an enlarged top plan view of the coin-sorting portion of the device shown in FIG. 27, with various coins superimposed thereon.

The coins are advanced along the plate 50 by a drive belt 17 which presses the coins down against the plate. As can be seen in FIG. 26, the exit end of the head 15 is cut out to allow the belt 17 to engage the upper surfaces of the coins even before they leave the disc 11. The aligned edges of the coins follow a gaging wall 58 which is a continuation of the wall 22 in the queuing head 15 and is interrupted only by the exit channels 51–56. The side walls of the exit channels 51–56 intersect the gaging wall 58 at oblique angles so that the driving force of the belt 17 on the upper surfaces of the coins drives the coins outwardly through their respective exit channels 51–56.

The drive belt 17 has a resilient outer surface 59 which is positioned close enough to the top surface of the plate 50 to press all the coins firmly against the plate. This capturing of the coins between the belt 17 and the plate 50 holds the coins precisely in the same relative positions established by the queuing device, with the aligned edges of the coins riding along the gaging wall 58. Consequently, the positions of the opposite edges (the upper edges as viewed in FIG. 26) of the coins are uniquely determined by the respective diameters of the coins, so that each denomination of coin will be intercepted by a different exit channel. The resilient surface of the belt 17 ensures that each coin is pressed down into its respective exit channel, and that each coin is exited from the plate 50 by the driving force of the belt 17 urging the coin against the longer (forward) side wall of its exit channel.

The inlet ends of successive exit channels 51–56 are located progressively farther away from the line of the gaging wall 58, thereby receiving and ejecting coins in order of increasing diameter. In the particular embodiment illustrated, the six channels 51–56 are positioned and dimensioned to successively eject the six U.S. coins in order of increasing size, namely, dimes (channel 51), pennies (channel 52), nickels (channel 53), quarters (channel 54), dollars (channel 55), and half dollars (channel 56). The inlet ends of the exit channels 51–56 are positioned so that only one particular denomination can enter each channel; the coins of all other denominations reaching a given exit channel extend laterally beyond the inlet end of that particular channel so that those coins cannot enter the channel and, therefore, continue on to the next exit channel.

For example, the first exit channel 51 is intended to discharge only dimes, and thus the inlet end **51*a* of this channel is spaced away from the gaging wall 58 by a distance that is only slightly greater than the diameter of a dime. Consequently, only dimes can enter the channel 51. Because one edge of all denominations of coins engages the gaging wall 58, all denominations other than the dime extend beyond the inlet end 51*a* of the channel 51**, thereby preventing all coins except the dimes from entering that particular channel.

Of the coins that reach channel 52, only the pennies are of small enough diameter to enter that exit channel. All other denominations extend beyond the inlet end of the channel 52 so that they remain gripped between the sorting rail and the resilient belt. Consequently, such coins are rotated past the channel 52 and continue on to the next exit channel.

Similarly, only nickels can enter the channel 53, only quarters can enter the channel 54, only dollars can enter the channel 55, and only half dollars can enter the channel 56.

In the particular embodiment of the sorting rail 16 shown in FIGS. 26–30, the exit channels 51–56 are narrower at the entry ends than at the exit ends. The change in channel width occurs at the gaging wall 58. The narrowing of the channels at their entry ends provides a wider coin-support area between each pair of adjacent exit channels, which helps prevent undesired tilting of coins as they pass over successive exit channels. Undesired tilting of coins can result in missorting.

Figure 28:
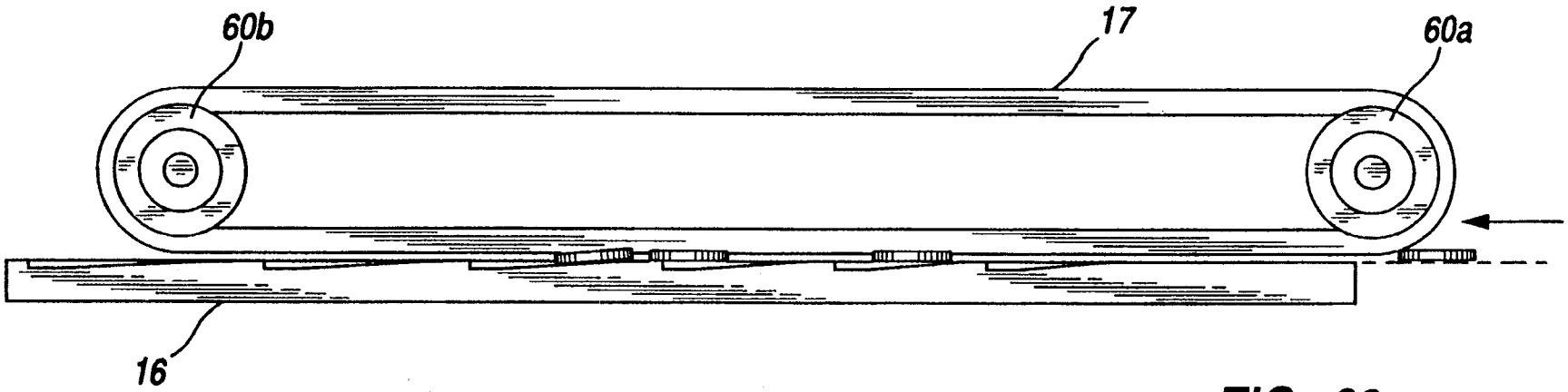
FIG. 28 is a side elevation of the mechanism shown in FIG. 27, with the addition of a drive belt.
Figure 30B:
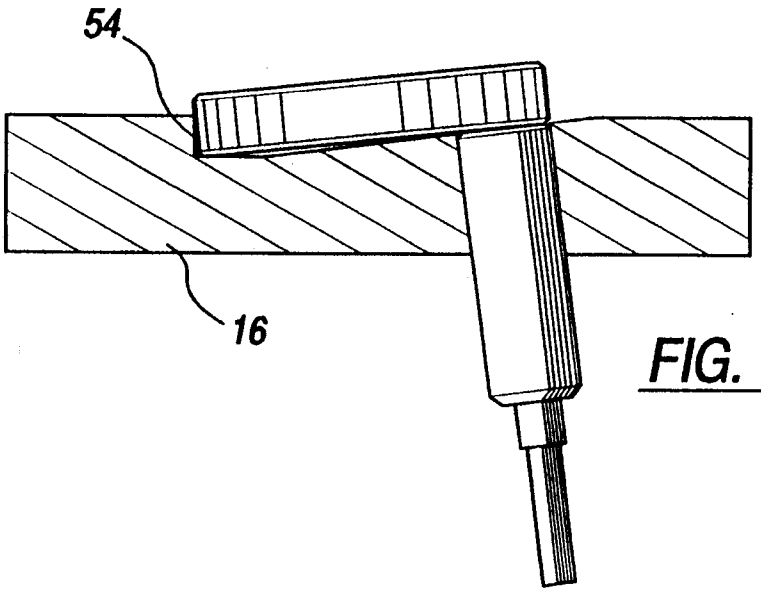
FIGS. 30*a* and 30*b* are enlarged sections taken generally along line 30—30 in FIG. 27, showing the coins in full elevation.
Figure 30A:
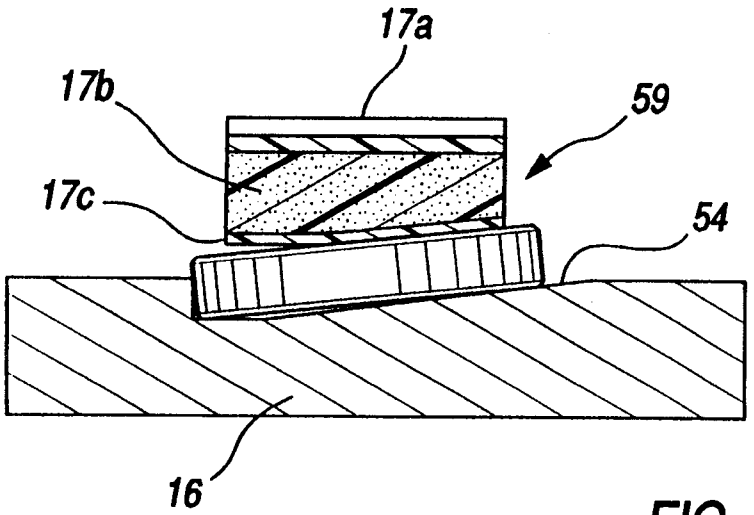

As can be seen in FIGS. 28 and 30, the bottom wall of each of the exit channels 51–56 is tapered across the width of the channel, so that the maximum depth is along the longer, forward side wall of the channel. This tapering of the bottom wall causes the coins to tilt as they are being exited through the channels 51–56, thereby ensuring engagement of each coin with the forward side wall of its respective channel. This further ensures that each coin will remain in the desired exit channel, avoiding missorting.

To permit exact bag stopping, it is preferred to count each sorted coin before it is exited from the sorting rail 16. For this reason, coin sensors 51 through 56 for the six different coin denominations are located within the exit channels 51–56. With this arrangement, the sensing of the last coin in a desired number of coins of a prescribed denomination can be used to stop the drive belt 17 before the next coin of that denomination is discharged from the sorting rail.

Figure 29:
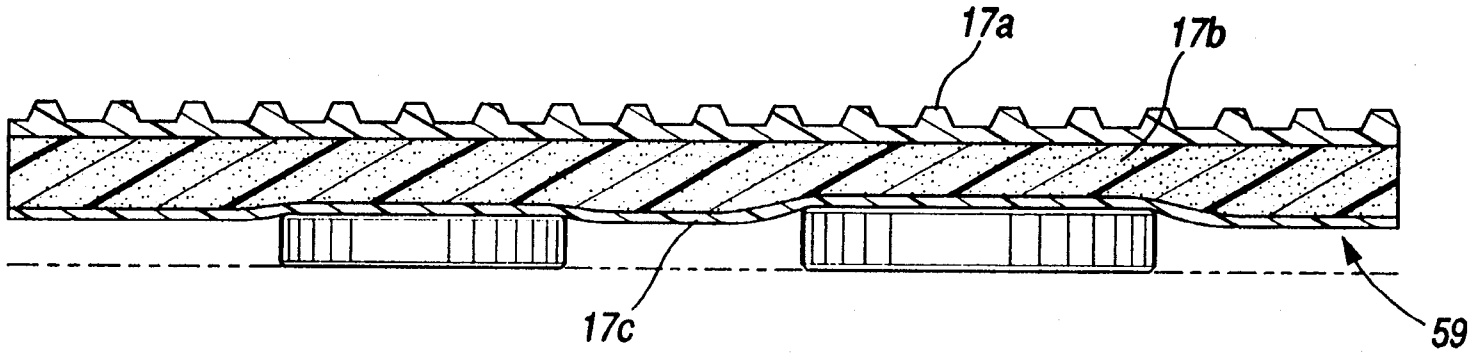
FIG. 29 is an enlarged section taken generally along line 29—29 in FIG. 27, showing the coins in full elevation.

As shown in FIGS. 29 and 30, the drive belt 17 preferably has a laminated construction. The inside surface of the belt is made of a layer 17*a* of relatively hard material, forming a toothed surface for positive engagement with both a driven pulley 60*a* and an idler pulley 60*b*. The thick central layer 17*b* of the belt is made of a relatively soft, resilient material, such as a closed-cell foam polymer. The outer surface of the belt which engages the coins is formed by a thin layer 17*c* of a tough flexible polymer which can conform to the shapes of the coins (see FIG. 29) and yet withstand the abrasive effect of coins sliding across the belt as they are exited through the channels 51–56.

Figure 31:
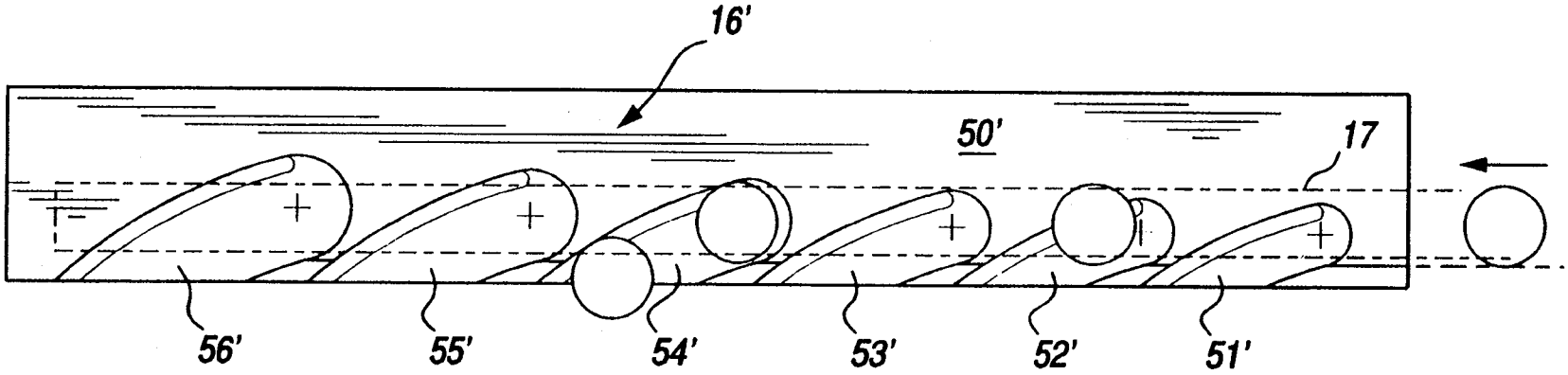
FIG. 31 is a plan view of a modified coin-sorting mechanism.

FIG. 31 illustrates a modified sorting rail 16' forming curved exit channels 51'–56'. The curved configuration of the exit channels permits a more compact arrangement of the channels, which in turn permits the use of a shorter plate 50'.

Figure 32:
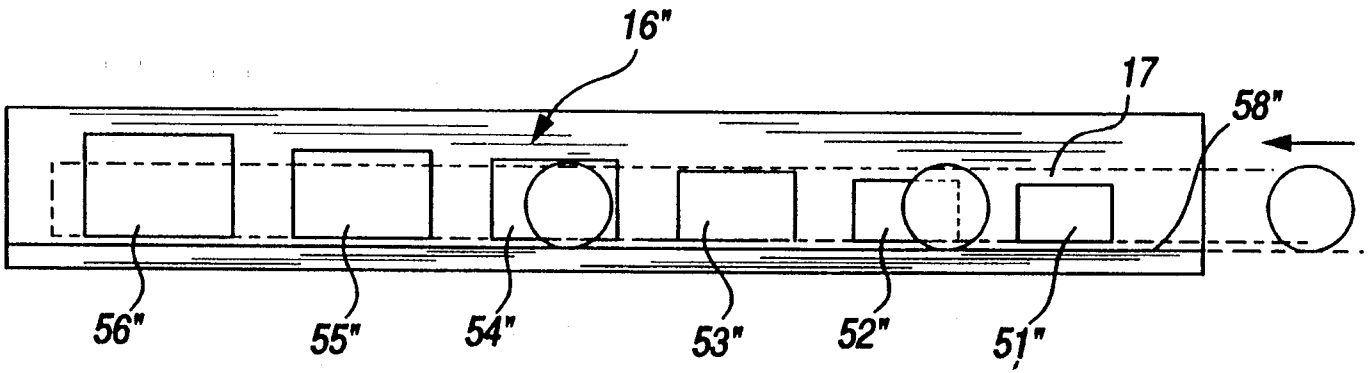
FIG. 32 is a plan view of another modified coin-sorting mechanism.

FIG. 32 illustrates another modified sorting rail 16'' which replaces the exit channels with a series of apertures 51''–56'' having successively greater widths. Each aperture is spaced slightly away from the gaging wall 58'' so that the coins are continuously supported along the gaging wall. When a coin edge farthest from the gaging wall 58'' falls within one of the apertures 51''–56'', that coin is pressed into and through the aperture by the resilient belt 17''. Only dimes can enter the first aperture 51'', only pennies can enter the second aperture 52'', and so on.

Figure 33:
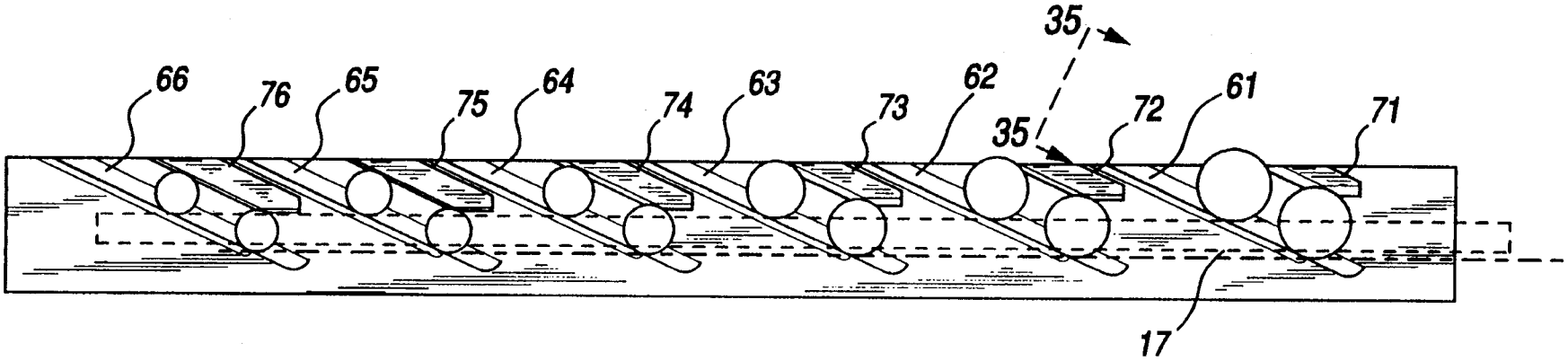
FIG. 33 is a plan view of still another modified coin-sorting mechanism.

FIG. 33 illustrates a further modified sorting rail which sorts coins in order of decreasing diameter. Again, the aligned edges of the coins follow a common linear path, although in this case the rail does not include a positive gaging wall. The coins traverse six successive exit channels, 61–66, but in this case all the channels are the same, extending from one edge of the plate across the full width of the coin path. Exiting of the coins is controlled by six successive ramps 71–76 which engage the non-aligned edge portions of progressively smaller coins to tilt the engaged coins into the exit channels 61–66. Any coins which are not engaged and tilted by any given ramp 71–76 simply ride over the corresponding exit channel. All the exit channels are narrower than the diameter of the smallest coin, and thus none of the coins can enter any of the exit channels unless the coin is tilted into one of the channels.

Figure 34:
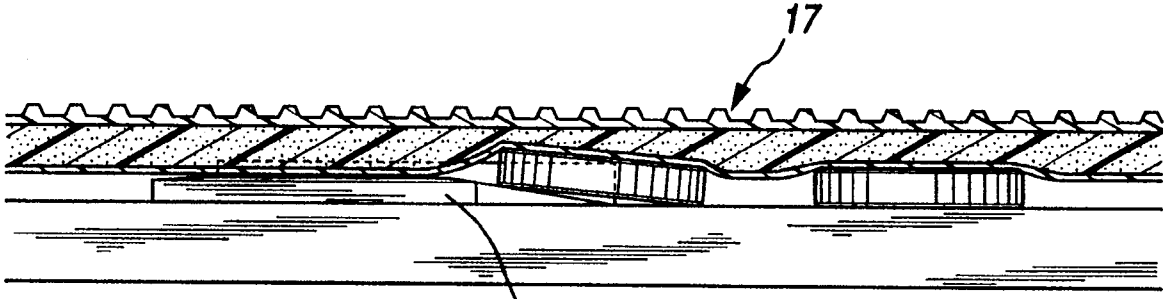
FIG. 34 is an enlarged section taken generally along line 34—34 in FIG. 33, showing the coins in full elevation.
Figure 35:
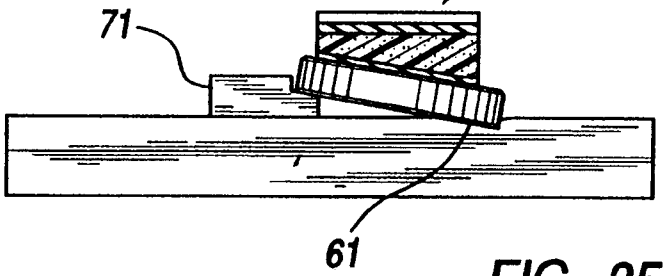
FIG. 35 is an enlarged section taken generally along line 35—35 in FIG. 33, showing the coins in full elevation.

The first ramp 71 is positioned to engage only the largest-diameter coin. As can be seen in FIG. 34, the outer portion of the coin rides up the ramp 71 to tilt the leading edge of the coin into the adjacent exit channel 61. The coin is maintained in this tilted position by a tapered shoulder 71*a* (see FIG. 35) which continues to the edge of the plate. All the smaller-diameter coins bypass the ramp 71 and continue on to the second ramp 72, which engages only the coins with the second largest diameter. These coins are tilted into the exit channel 62. The remaining coins bypass the ramp 72 and continue on to the ramps 73, 74, 75 and 76 which are positioned to engage progressively smaller coins, as illustrated in FIG. 33.

Figure 36:
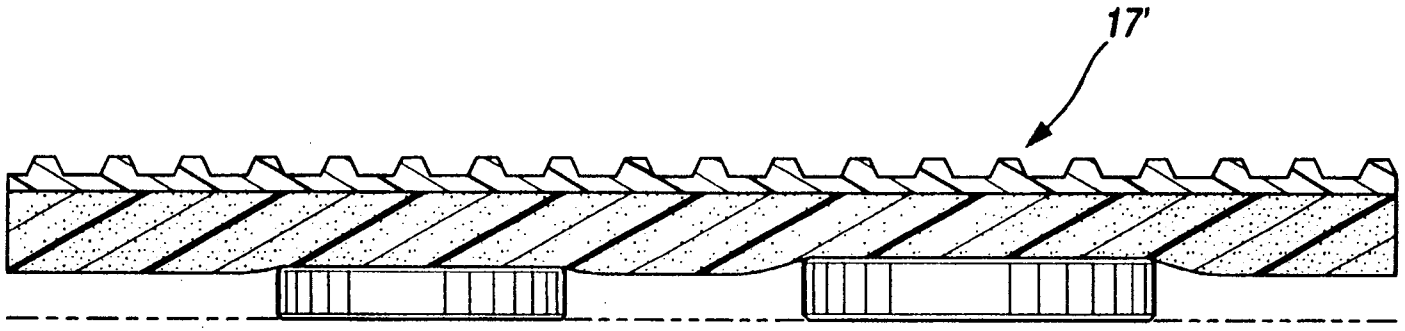
FIG. 36 is an enlarged section of a modified drive belt.
Figure 37:
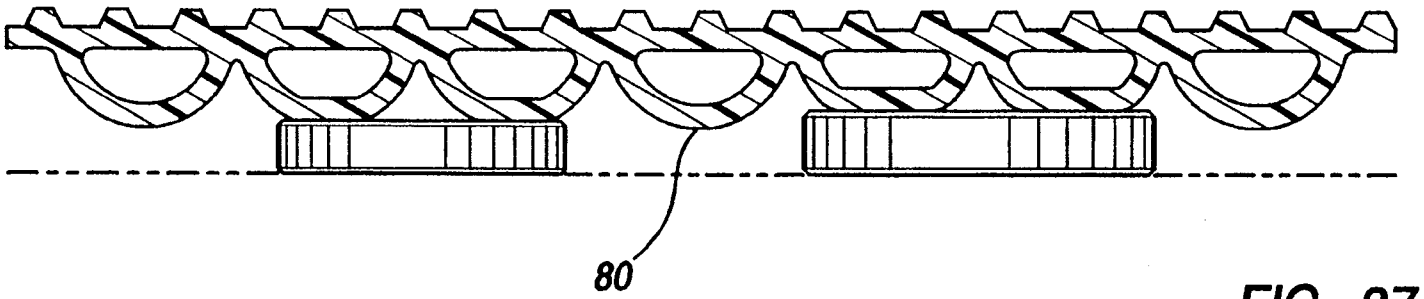
FIG. 37 is an enlarged section of another modified drive belt.

FIGS. 36 and 37 illustrate two alternative embodiments of the driving belt 17. In FIG. 36, the belt 17' has only two layers, omitting the abrasion-resistant outer layer. In FIG. 37, the resilient foam is replaced with a series of hollow transverse elastic ribs 80 which are molded as an integral part of the same material which forms the toothed inside surface of the belt. The desired resilience is provided by deformation of the elastic ribs 80 by the engaged coins, as shown in FIG. 37.

Figure 38:
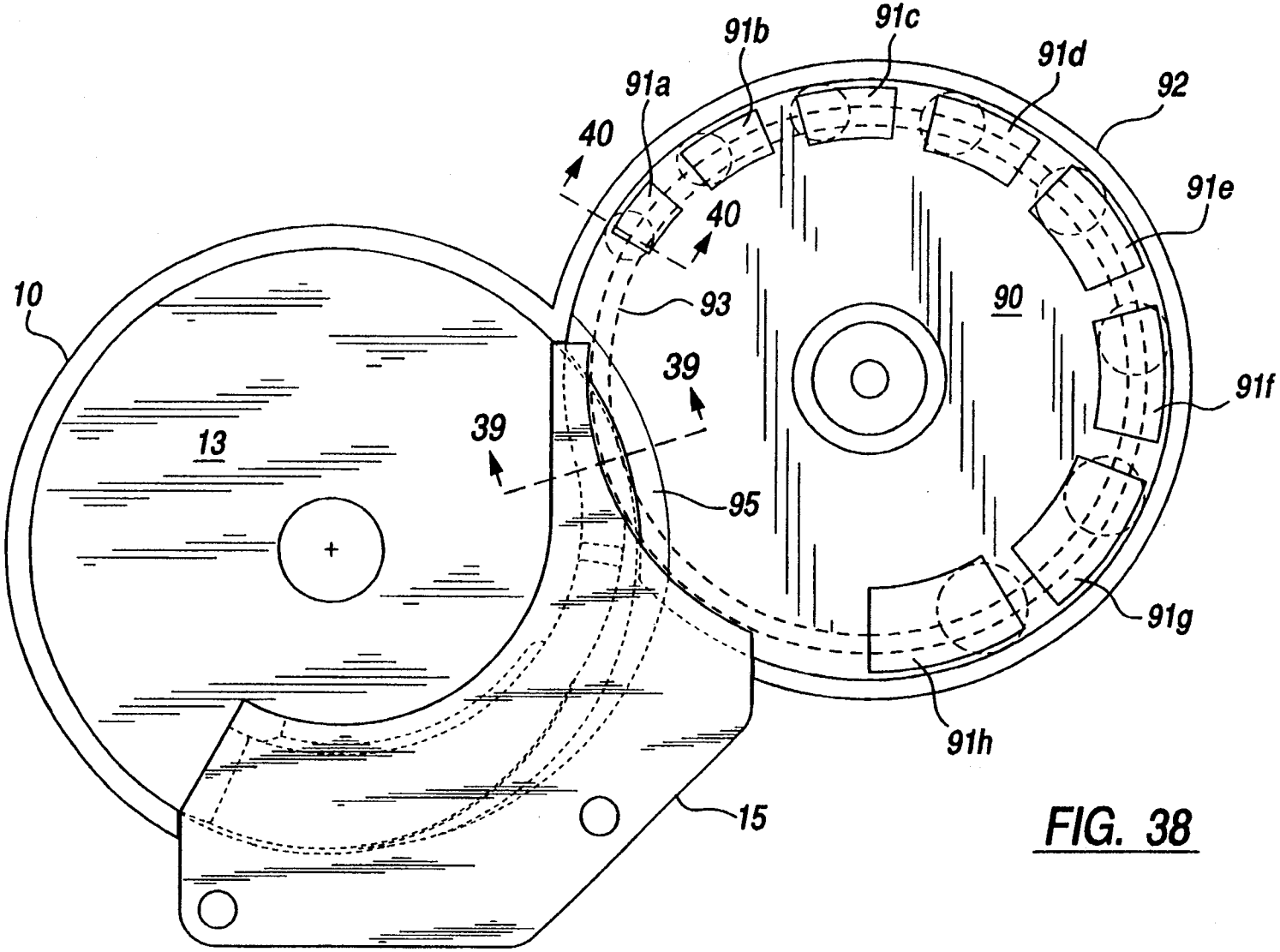
FIG. 38 is a top plan view of a slightly modified form of the queuing device feeding a disc-type coin sorter.

As illustrated in FIG. 38, the queuing device may be used to feed a circular coin sorting device rather than a straight sorting rail. Thus, in FIG. 38 the coins are sorted by passing the coins over a series of apertures formed around the periphery of a stationary sorting disc 90. The apertures 91*a*–91*h* are of progressively increasing radial width so that the small coins are removed before the larger coins. The outboard edges of all the apertures 91*a*–91*h* are spaced slightly away from a cylindrical wall 92 extending around the outer periphery of the disc 90 for guiding the outer edges of the coins as the coins are advanced over successive apertures. The disc surface between the wall 92 and the outer edges of the apertures 91*a*–91*h* provides a continuous support for the outer portions of the coins. The inner portions of the coins are also supported by the disc 90 until each coin reaches its aperture, at which point the inner edge of the coin tilts downwardly and the coin drops through its aperture.

Figure 40:
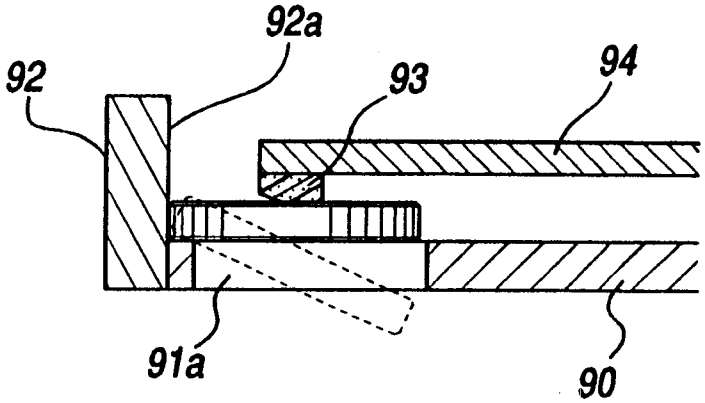
FIG. 40 is an enlarged section taken generally along the line 40—40 in FIG. 38.
Figure 39:
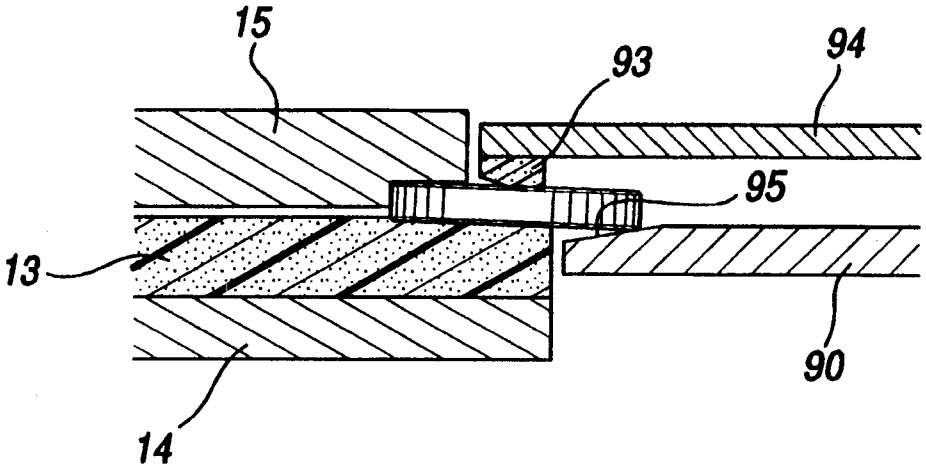
FIG. 39 is an enlarged section taken generally along the line 39—39 in FIG. 38.

To advance the coins along the series of apertures 91*a*–91*h*, the upper surfaces of the coins are engaged by a resilient rubber ring 93 attached to the lower surface of a rotating disc 94 (FIGS. 39 and 40). The lower surface of the rubber ring 93 is spaced sufficiently close to the upper surface of the disc 90 that the rubber ring presses the coins of all denominations, regardless of coin thickness, firmly down against the surface of the disc 90. Consequently, when a coin is positioned over the particular aperture 91 through which that coin is to be discharged, the resilient rubber ring presses the coin down through the aperture.

As can be seen in FIG. 38, the disc 94 which carries the rubber ring 93 overlaps the disc 11 which carries the coins under the queuing head 15. The queuing head 15 and the disc 90 are both cut away to allow for this overlap of the two discs. Because of the overlap, coins which are advanced along the channel 21 formed by the queuing head 15 are actually engaged by the rubber ring 93 before the coins leave the disc 11. As each coin approaches the periphery of the disc 11, the outer portion of the coin begins to project beneath the rubber ring 93. This projection starts earlier for large-diameter coins than for small-diameter coins.

Each coin is engaged simultaneously by both the resilient pad 13 on the underside of the coin and the rubber ring 93 on the top side of the coin for a brief interval before the coin is actually transferred from the disc 11 to the disc 90. As can be seen in FIG. 38, the coin-guiding inner edge of the channel 21 in the queuing head 15 begins to follow an extension of the inner surface 92*a* of the wall 92 at the exit end of the queuing head 15, so that the inboard edges of the coins on the disc 11 (which become the outboard edges of the coins when they are transferred to the disc 90) are smoothly guided by the inner wall of the channel 21 and then the inside surface of the wall 92 as the coins are transferred from the disc 11 to the disc 90.

Before the coins in the channel 21 of the queuing head 15 reach the region of overlap between the two discs, the coins engage a ramp 96 which presses the coins of all denominations even more firmly down into the resilient pad 13. The coins then remain so pressed until they leave the disc 11. This additional pressing of the coins into the pad 13 ensures that the coins remain captured during the transfer process, i.e., ensuring that the coins do not fly off the disc 11 by centrifugal force before they are transferred completely to the disc 90.

To facilitate the transfer of coins from the disc 11 to the disc 90, the outer edge portion of the top surface of the disc 90 is tapered at 95 (see FIG. 39). Thus, even though the coins are pressed into the pad 13, the coins do not catch on the edge of the disc 90 during the coin transfer.

I claim:

1. A coin queuing device for receiving coins of the same or mixed denominations and delivering the coins to a fixed feed station in single file, in a single layer, and with one edge of each coin positioned at a common reference location, said device comprising a rotatable disc having a resilient upper surface, drive means for rotating said disc, coin feed means for feeding coins to said resilient upper surface of said disc, a coin containment wall extending around the outer periphery of said disc to prevent coins from flying off the disc when the disc is rotated, and a stationary head positioned over a portion of said disc for engaging the upper surfaces of coins carried beneath said head by said disc, said head including a channel for receiving coins which are carried on the surface of said rotatable disc beneath said stationary head, at least a portion of the radially inner wall of said channel spiralling outwardly relative to the center of rotation of said disc to engage the radially inner edges of all the coins that enter the channel, said inner wall extending to the outer periphery of said disc for discharging from said disc the coins which are advanced along said inner wall, said coin containment wall being interrupted in the region adjacent said inner wall to permit the discharge of coins from said disc, the upper surface of at least the exit end of said channel being positioned sufficiently close to said resilient upper surface of said disc to press coins of all denominations down into said resilient surface as the coins are being discharged from the disc.

2. The coin queuing device of claim 1 wherein the radially outer wall of said channel converges toward said inner wall, said outer wall tapering upwardly toward said inner wall so that coins forced against said outer wall by the rotational movement of said disc and the guidance of said inner wall will pass beneath said outer wall, the lower surface of said stationary head outboard of said outer wall continuing to press said coins against said resilient surface to prevent coins from moving outwardly away from said inner wall.

3. The coin queuing device of claim 1 wherein said coin containment wall is a stationary member adjacent the outer periphery of said disc.

4. The coin queuing device of claim 1 wherein said stationary head extends along less than half of the periphery of said disc.

5. The coin queuing device of claim 1 wherein the lower portion of said inner wall is bevelled so that the lower coin in a pair of overlapping coins passes beneath said inner wall and leaves the channel for recirculation on said disc.

6. The coin queuing device of claim 1 which includes coin-conveying means for receiving coins discharged from said disc, said coin-conveying means including a stationary support surface for receiving and supporting the discharged coins and forming a guiding wall for guiding the received coins along a desired path, and a movable coin-driving member spaced above said support surface and having a resilient lower surface for engaging the upper surfaces of coins of all denominations and driving the engaged coins along said guiding wall.

7. The coin queuing device of claim 6 wherein said resilient lower surface of said coin-driving member tapers downwardly toward said stationary support surface where the discharged coins are first engaged by said resilient lower surface, so as to form an entry throat for receiving coins between said support surface and said coin-driving member.

8. The coin queuing device of claim 6 wherein the upper surface of said stationary support surface is positioned below the upper surface of said rotatable disc for receiving coins pressed into said resilient upper surface of said disc.

9. The coin queuing device of claim 6 wherein said coin-driving member is a driven belt, and said guiding wall on said stationary support surface defines a linear path for the coins.

10. The coin queuing device of claim 6 wherein said coin-driving member is a rotatable disc or annulus, and said guiding wall on said stationary support surface defines an arcuate path for the coins.

11. A power rail coin sorter comprising an elongated horizontal plate forming a series of coin exit channels spaced along the length thereof and extending inwardly from one of the elongated edges of the plate, a coin drive belt positioned over said elongated plate and having a resilient lower surface for engaging the upper surfaces of the coins supplied to said plate and pressing the engaged coins against the upper surface of said plate while advancing the coins longitudinally along the upper surface of the plate and across the inboard ends of said exit channels, and coin queuing means for supplying coins of mixed denomination to one end of said elongated plate, said coins being supplied in a single file of flat coins with the edges of the coins closest to the exit ends of said exit channels in alignment with each other, the inboard ends of said exit channels being located progressively farther away from said elongated plate edge to which said exit channels extend, so that the non-aligned edges of progressively larger-diameter coins enter the inboard ends of successive exit channels along the length of said plate.

12. The power rail coin sorter of claim 11 wherein said elongated plate forms a coin-gaging wall for guiding said aligned edges of said coins along said plate.

13. The power rail coin sorter of claim 11 wherein each of said exit channels extends at an oblique angle from the coin path upstream of the exit channel, so that the drive belt that advances coins longitudinally along said plate also drives the coins through the exit channels to the exit ends of the channels at the elongated edge of said plate.

14. The power rail coin sorter of claim 12 wherein the portions of said exit channels inboard of said gaging wall are narrower than the diameters of the respective coins exited through said channels.

15. The power rail coin sorter of claim 11 wherein said exit channels are curved.

16. The power rail coin sorter of claim 11 wherein the upper surfaces of said exit channels are inclined upwardly toward the forward side walls of the respective channels.

17. The power rail coin sorter of claim 11 which includes coin-sensing means within each of said exit channels for counting the number of sorted coins of each different diameter.

* * * * *